US012108915B2

(12) United States Patent
Kullman et al.

(10) Patent No.: US 12,108,915 B2
(45) Date of Patent: Oct. 8, 2024

(54) DISPENSER FOR DISPENSING WEB MATERIAL FROM A ROLL

(71) Applicant: Essity Hygiene and Health Aktiebolag, Gothenburg (SE)

(72) Inventors: Marcus Kullman, Borlänge (SE); Johanna Enmalm, Borlänge (SE); Martina Johansson, Borlänge (SE); Mattias Bengtsson, Gothenburg (SE); Tomas Gandemo, Gothenburg (SE)

(73) Assignee: Essity Hygiene and Health Aktiebolag, Gothenburg (SE)

( * ) Notice: Subject to any disclaimer, the term of this patent is extended or adjusted under 35 U.S.C. 154(b) by 570 days.

(21) Appl. No.: 17/613,543

(22) PCT Filed: Jul. 5, 2019

(86) PCT No.: PCT/EP2019/068088
§ 371 (c)(1),
(2) Date: Nov. 23, 2021

(87) PCT Pub. No.: WO2021/004604
PCT Pub. Date: Jan. 14, 2021

(65) Prior Publication Data
US 2022/0233031 A1 Jul. 28, 2022

(51) Int. Cl.
*A47K 10/36* (2006.01)
*A47K 10/32* (2006.01)
*A47K 10/38* (2006.01)

(52) U.S. Cl.
CPC ..... *A47K 10/3687* (2013.01); *A47K 10/38* (2013.01); *A47K 2010/3206* (2013.01);
(Continued)

(58) Field of Classification Search
CPC ..... A47K 10/3687; A47K 10/3836; A47K 10/405
See application file for complete search history.

(56) References Cited

U.S. PATENT DOCUMENTS 3,184,176 A 5/1965 Tucker et al.
3,637,276 A 1/1972 Bump
(Continued)

FOREIGN PATENT DOCUMENTS

CL 2021003259 A1 9/2022
JP H077588 U 2/1995

OTHER PUBLICATIONS

Notification of the First Office Action issued on Jul. 27, 2022, by the Chinese Patent Office in corresponding Chinese Patent Application No. 201980096586.7, and an English Translation of the Office Action. (9 pages).
(Continued)

*Primary Examiner* — William A. Rivera
(74) *Attorney, Agent, or Firm* — Buchanan Ingersoll & Rooney PC

(57) ABSTRACT

Dispenser for dispensing web material from a roll, the dispenser including a housing and a spindle intended to rotatably support a roll of web material during dispensing. The spindle is movable between a loading position and a dispensing position. The dispenser further includes a deflecting member being movable between a protruding position protruding towards the spindle in dispensing position and a retracted position retracted into the housing away from the spindle in dispensing position. The deflecting member is connected to a blocking member moving in response to the movement of the deflecting member.

23 Claims, 10 Drawing Sheets

(52) U.S. Cl.
CPC ..... *A47K 2010/3233* (2013.01); *A47K 2010/3246* (2013.01); *A47K 2010/326* (2013.01); *A47K 2010/3681* (2013.01)

(56) References Cited

U.S. PATENT DOCUMENTS

| | | | | |
|---|---|---|---|---|
| 4,034,924 | A | 7/1977 | Carlisle | |
| 4,260,117 | A * | 4/1981 | Perrin | A47K 10/3687 242/564.2 |
| 5,813,624 | A | 9/1998 | Grasso et al. | |
| 2009/0255951 | A1* | 10/2009 | Granger | A47K 10/3656 221/56 |
| 2020/0029752 | A1* | 1/2020 | Zimmermann | A47K 10/3687 |
| 2020/0305656 | A1* | 10/2020 | Landa | A47K 10/3687 |
| 2021/0032063 | A1* | 2/2021 | Janek | A47K 10/38 |
| 2022/0313030 | A1* | 10/2022 | Elliott | A47K 10/3836 |

OTHER PUBLICATIONS

International Search Report (PCT/ISA/210) with translation and Written Opinion (PCT/ISA/237) mailed on Mar. 12, 2020, by the European Patent Office as the International Searching Authority for International Application No. PCT/EP2019/068088.

Office Action (First Examination Report) issued Dec. 2, 2022, by the Chile Patent Office Action in corresponding Chilean Patent Application No. 202103260. (19 pages).

* cited by examiner

DISPENSER FOR DISPENSING WEB MATERIAL FROM A ROLL

TECHNICAL FIELD

The disclosure relates to a dispenser for dispensing web material from a roll, the dispenser comprising a housing and a spindle intended to rotatably support a roll of web material during dispensing. The spindle is movable between a loading position and a dispensing position.

BACKGROUND

Various types of dispensers for dispensing tissue paper from rolls are known in the art. In public restrooms the roll dispensers commonly comprise a housing to protect the roll from contamination and the tissue paper is accessible through a dispensing opening in housing. Dispensers intended for coreless roll dispensing comprise a spindle for holding the roll during dispensing. In one common type of dispenser the dispensing opening is arranged in the front cover of the dispenser, and the spindle is arranged parallel to the back of the dispenser such that the face of the tissue paper roll face the dispensing opening. Typically, the front cover is openable which allows the service personnel to access the spindle for loading the roll of tissue paper.

Sometimes the service personnel load the roll of tissue paper in the wrong orientation such that the paper tail is arranged at the back of the dispenser rather than at the front of the dispenser, which makes dispensing less user-friendly for the end user. Moreover, sometimes the service personnel load the wrong type of roll in the dispenser which also may affect the end user experience. Loading dispensers is an important part of the service personnel's tasks and should therefore preferably be as easy and quick as possible. It is also desired that correct loading of rolls of tissue paper is facilitated in order to make sure tissue paper is readily available for the end user.

SUMMARY

The dispenser disclosed herein aims to overcome the above mentioned issues, and aims to fulfill the desires of a functional dispenser that is easy to load correctly. The disclosure further provides a method of loading a roll onto such a dispenser.

Further advantages are achieved by implementing one or several of the features described herein.

The disclosure relates to a dispenser for dispensing web material from a roll. The dispenser comprises a housing, a spindle intended to rotatably support a roll of web material during dispensing the spindle being movable between a loading position and a dispensing position. The housing defines an interior of the dispenser. The dispenser further comprises a deflecting member which is movable between a protruding position in which the deflecting member is protruding towards the spindle in dispensing position and a retracted position in which the deflecting member is retracted into the housing away from the spindle in dispensing position. The deflecting member is connected to a blocking member moving in response to the movement of the deflecting member.

The deflecting member may be movable between its two positions in response to a roll being loaded in the dispenser on the movable spindle. The deflecting member may move into retracted position when a force is applied to it and may be arranged such as to come into contact with a roll arranged on the spindle as the spindle moves between loading and dispensing position. The deflecting member may stay in retracted position as long as a roll arranged on the spindle in dispensing position exerts a force onto the deflecting member. The dispenser thus provides the service personnel with instant feedback regarding the positioning of the roll in the dispenser, and allows for the service personnel to notice if the roll has not been loaded correctly. This in turn eliminates the risk of an end-user detecting a faulty loaded roll or experiencing a dispenser with reduced dispensing user-friendliness.

The deflecting member may interact with a resilient member arranged to allow the deflecting member to flex back into protruding position from retracted position. The resilient member is in relaxed state when the deflecting member is in its protruding position. The deflecting member moves into retracted position when a force is applied to it, thereby forcing the resilient member to tense state. Once the tension applied to the deflecting member is removed the resilient member relaxes and moves the deflecting member back into protruding position. The resilient member connects the deflecting member to the housing of the dispenser.

The deflecting member is arranged in the housing in order to receive a first end of the spindle when the spindle is in dispensing position. The dispensing position of the spindle is arranged in the interior of the dispenser housing. The loading position of the spindle is arranged outside of the interior of the housing, thereby allowing the service personnel to load a roll onto the spindle. The loading position, positioning the spindle outside the interior of the dispenser, facilitates easy access to the spindle during loading.

The deflecting member in protruding position engages the first end of the spindle. The deflecting member may comprise a guiding groove adapted to receive the first end of the spindle and guide it into an engaged position in the deflecting member when the spindle is in dispensing position. The guiding groove thereby stabilizes the spindle in dispensing position during dispensing of web material from a roll disposed on the spindle.

A second end of the spindle may be arranged on an arm attached to the housing, the arm being allowed to pivot outwards from the interior of the housing to put the spindle in loading position, thereby allowing loading of a roll onto the spindle in loading position. The dispenser is provided with a back, and the arm pivots in a direction perpendicular to the back of the dispenser. The spindle is attached perpendicular to the arm thereby extending in horizontal direction parallel to the back of the dispenser. The back of the dispenser is adapted to be fastened to a wall during use of the dispenser. The arm pivoting outwards from the interior of the housing provides access to the first end of the spindle from the side and allows loading easy of the dispenser.

The web material may be tissue paper. In one example the tissue paper is toilet tissue paper. The roll may be a coreless roll. The spindle may be provided with a sleeve facilitating the coreless roll to rotate about the spindle.

The movement of the deflecting member may translate into movement of the blocking member in and out of an engagement slot arranged in the dispenser housing. The blocking member may comprise a blocking position in which the engagement slot is blocked. The blocking position may be reached when the deflecting member is in retracted position.

In one example the housing comprises at least a top wall, side walls and a front cover. The deflecting member is arranged to protrude from a side wall of the dispenser housing, the side wall being a wall adjacent a side of a roll loaded in the dispenser. The front cover allows access to the rolls for loading i.e. refilling the dispenser. The front cover may be hinged, in one example from a lower part of the housing. The front cover may be hinged from the lower part of the side walls, the back wall, or from a bottom wall. The engagement slot, which the blocking member moves in and out of in response to the movement of the deflecting member, may be arranged in the top wall of the dispenser housing.

The front cover may have a closed and opened state, and comprising an engagement member arranged to interact with the engagement slot when the front cover in closed state. The blocking member blocks the engagement slot when the deflecting member is in its retracted position. The interaction between the engagement member and the engagement slot is arranged to keep the front cover closed so if the engagement slot is blocked by the blocking member in blocking position the front cover cannot stay in closed state. The engagement member may be a locking hook. If a roll is faulty positioned in the dispenser or does not fit in the dispenser the blocking member in blocking position will make sure the dispenser front cover is in opened state only. This allows the service personnel to notice their mistake and exchange the faulty roll or change its orientation on the spindle into correct position.

The front cover may have a dispensing opening which provides access to the rolls for dispensing when the front cover is in closed state. The web of paper is dispensed through the dispensing opening. A roll, when arranged on the spindle, is visible through the dispensing opening when the spindle is in dispensing position and the front cover is closed. This allows easy access to the web material for dispensing.

In one non-limiting example the blocking member may be movable in a direction perpendicular to the movement of the deflecting member. The movement may be translated by means of a connection member translating a horizontal movement of the deflecting member into vertical movement of the blocking member. The movement of the blocking member may also be rotational, linear etc. The connection member connects the blocking member to the deflecting member. The blocking member is arranged in blocking position when the deflecting member is in its retracted position. The blocking member in blocking position hinders the dispenser from functioning as intended, i.e. it hinders proper loading and dispensing.

In one example the deflecting member is connected to the blocking member by a rod translating a horizontal movement of the deflecting member into vertical movement of the blocking member.

The dispenser may further comprises an indication window and an indication being visible in the indication window when the blocking member is in the engagement slot, thereby indicating that the front cover can not be left in closed state since the engagement member of the front cover cannot interact with the engagement slot in the housing. The indication is arranged such that it moves in and out of the indication window with the movement of the blocking member in and out of blocking position.

The spindle may be attached perpendicular to the arm, the arm being hinged at a hinge point to a support member, and the arm being allowed to pivot about the hinge point. The arm facilitates the spindle dispensing position in which the spindle is arranged within the housing of the dispenser, and the spindle loading position in which the spindle is arranged outside the housing of the dispenser in order to allow loading of a roll onto the spindle, the arm being pivotable between the two positions. This provides easy access to the spindle in loading position such that loading of a new roll onto the spindle is facilitated.

The deflecting member may have a shape adapted to fit in an indentation in the side of a roll arranged on the spindle. The deflecting member is adapted to be pushed into the retracted position in the dispenser housing when coming into contact with a side of a roll comprising an indentation complementary to the shape of the deflecting member as the spindle is moved into dispensing position, and the deflecting member being adapted to flex back into protruding position when the spindle reaches dispensing position in which the first end of the spindle is in engaged position. As a result, only rolls with an indentation having a shape which is complementary to the shape of the deflecting member allows the deflecting member to flex back into protruding position and subsequently moves the blocking member out of blocking position. If a roll which does not have an indentation of complementary shape is placed in dispensing position the deflecting member remains in retracted position, and the blocking member remains in blocking position. The front cover of the dispenser can not stay in closed state with such a roll in dispensing position. Hence, this allows the service personnel to detect that a roll is faulty loaded before walking away from the dispenser, and the issue can be corrected before it affects the end-user of the dispenser.

In one non-limiting example the shape of the deflecting member is at least partly frustoconical. The frustoconical shape may be chamfered at one side to facilitate the edge of a first side of a roll arranged on the spindle to pass the deflecting member during loading.

The dispenser may be a dual dispenser comprising two spindles intended to hold a roll respectively, and wherein the two spindles are movable between loading position and dispensing position independently from each other. The spindles may be arranged side-by-side in the dispenser, parallel to the back wall. The dispensing opening in the front cover of the dispenser is arranged such that is provides access to both spindles in dispensing position, i.e. access to both rolls when arranged in the dispenser, and may be provided with a lid movable between two positions such as to cover part of the dispensing opening so that only one roll at the time is accessible for dispensing.

The housing of the dual dispenser may comprise a central side wall arranged between the two spindles, a deflecting member being arranged in the central side wall protruding from the central side wall towards a first of the spindles in dispensing position in its protruding position and the deflecting member retracted into the central side wall away from the spindle in dispensing position in its retracted position. A first spindle is arranged to protrude from a first side wall, via an arm, such that the first end of the first spindle interacts with a deflecting member arranged in the central side wall. The second spindle is arranged to extend from the central side wall, via an arm, such that the first end of the second spindle interacts with a receiving part at the second side wall opposite the first side wall. The receiving part may or may not comprise a deflecting member. The receiving part may have the same shape as the deflecting member such that the receiving part fits in an indentation in a roll, the indentation being complementary to the shape of the deflecting member.

The deflecting member may also be arranged in one of the outer side walls of a dual dispenser, arranged to engage the first end of a spindle in dispensing position. The dual dispenser may further comprise two deflecting members, each arranged in an outer side wall or central side wall depending on how the spindles are arranged in the dual dispenser.

The dispenser may further comprise three or more spindles, and be intended to hold the corresponding number of rolls. The dispenser may also comprise two spindles intended to hold a roll respectively, and wherein the two spindles are movable between loading position and dispensing position simultaneously.

The disclosure also includes a dispenser for dispensing web material from a roll, the dispenser comprising a housing and a front cover having an opened and a closed state, a spindle intended to rotatably support a roll of web material during dispensing, the spindle being movable between a loading position and a dispensing position, a deflecting member resiliently movable between a retracted position in which the deflecting member is retracted in the housing and a protruding position in which the deflecting member is protruding towards the interior of the dispenser, wherein the front cover in its closed state is blocked from interaction with the housing when the deflecting member is in retracted position. The front cover can thereby not stay in closed state. The dispenser may further comprise the features mentioned in the disclosure above.

The disclosure also includes a dispenser for dispensing web material from a roll, the dispenser comprising a housing comprising an engagement slot and a front cover having a closed state and an opened state, the front cover comprising an engagement member arranged to interact with the engagement slot in closed position, a spindle rotatably supporting a roll of web material, the spindle being movable between a loading position and a dispensing position, a deflecting member resiliently movable between a protruding position in which the deflecting member is protruding towards the spindle dispensing position and a retracted position in which the deflecting member is retracted into the housing away from the spindle dispensing position. Moreover, the deflecting member is adapted to be moved into a retracted position by a first side of the roll when the spindle is moved from loading position to dispensing position, wherein the movement of the deflecting member translates into moving a blocking member into the engagement slot in order to hinder interaction between the engagement member and the engagement slot. The dispenser may further comprise the features mentioned in the disclosure above.

The first side of the roll facing the deflecting member is provided with an indentation complementary to the shape of the deflecting member such that the deflecting member is allowed to move back into protruding position and the blocking member moves out of the engagement slot. The roll may be a coreless roll of tissue paper.

The disclosure also discloses a method of loading a dispenser for dispensing web material from a roll, the dispenser comprising a housing and a front cover, a spindle adapted to rotatably support a roll of web material during dispensing, the spindle having a dispensing position and a loading position, a deflecting member having a shape and being movable between a protruding position protruding towards the spindle dispensing position and a retracted position retracted into the housing away from the spindle dispensing position. The method comprises the steps of placing a roll comprising an indentation complementary to the shape of the deflecting member on the spindle in loading position, moving the spindle from the loading position towards the dispensing position, allowing a first side of the roll, comprising the indentation, to push against the deflecting member in order to move it from the protruding position to the retracted position upon moving the spindle from loading position to dispensing position, wherein the movement of the deflecting member translates into movement of a blocking member into a blocking position thereby hindering the front cover from staying in closed state, and allowing the deflecting member to flex back into protruding position once the spindle is in dispensing position in order to move the blocking member out of the blocking position, and moving the front cover to a closed state.

The blocking position of the blocking member blocks an engagement slot arranged in the housing of the dispenser.

At least the first side of the roll comprises the indentation. The roll is placed on the spindle such that the indentation faces the deflecting member.

The method may further include locking the front cover in closed state by allowing an engagement member arranged on the front cover to interact with the engagement slot.

BRIEF DESCRIPTION OF THE FIGURES

The present disclosure is illustrated by way of examples and not limited to the accompanying drawings, in which like references indicate similar elements.

DETAILED DESCRIPTION

It is to be understood by one of ordinary skill in the art that the following is a description of exemplary embodiments only, and is not intended as limiting the broader aspects of the present disclosure.

Figure 1A:
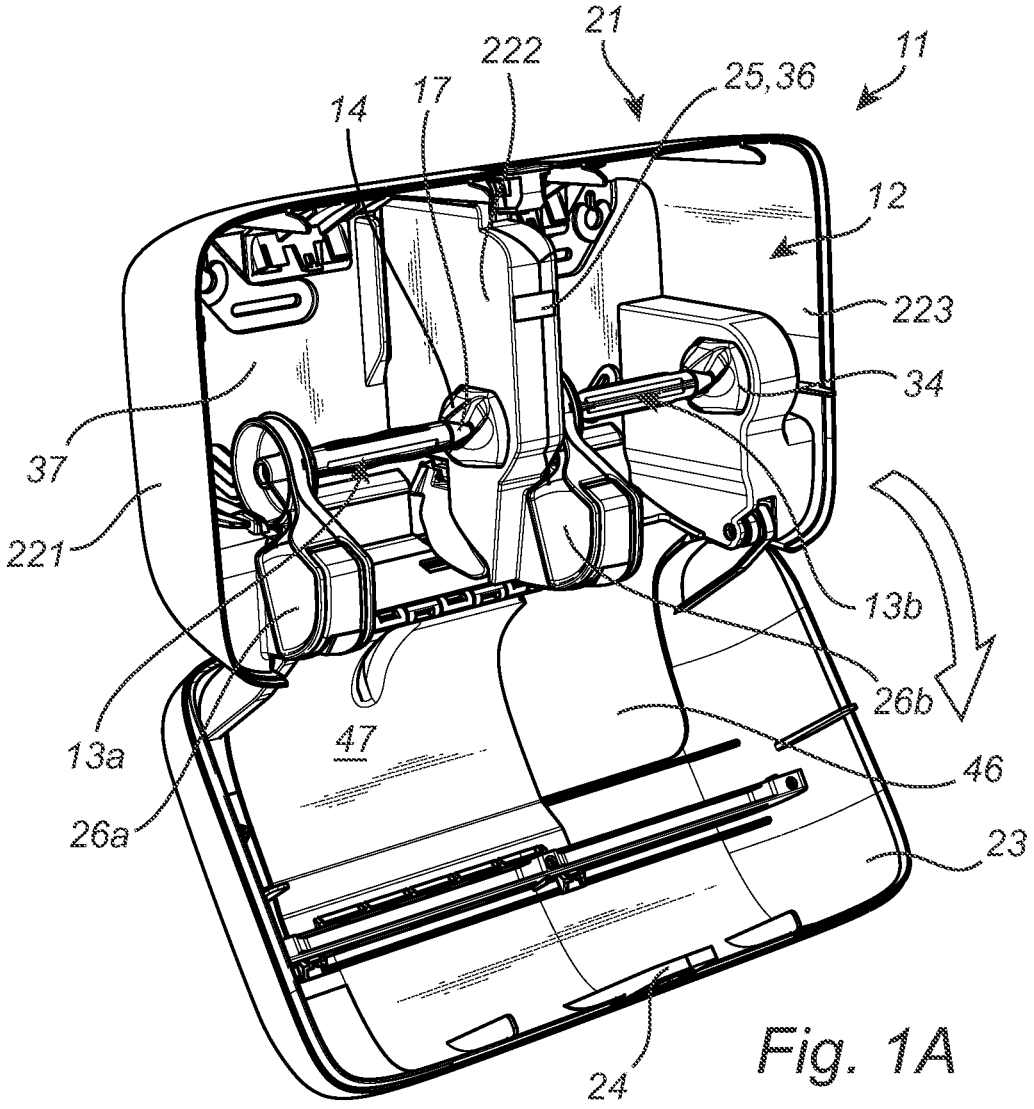
FIG. 1A is a perspective view of the dispenser disclosed herein, with both spindles in dispensing position.

FIG. 1A shows a dual dispenser 11 comprising a housing 12 defining an interior. The housing 12 comprises a back wall 37, a top wall 21, two outer side walls 221, 223 and a central side wall 222. A first and a second arm 26*a*, 26*b* is hinged at a respective hinge point 27 to a respective support member 28*a*, 28*b*, and the arms 26*a*, 26*b* are adapted to pivot about the hinge points 27. The first arm 26*a* is hinged at a first support member 28*a* arranged close to the first side wall 221, at the lower part of the back wall 37. The second arm 26*b* is hinged to a second support member 28*b* arranged at the lower part of the central side wall 222. The support members 28*a*, 28*b* and the arms 26*a*, 26*b* extend in a direction perpendicular from the back wall 37 of the dispenser 12, and the arms 26*a*, 26*b* are adapted to pivot in same direction. Each arm 26*a*, 26*b* is provided with a spindle 13*a*, 13*b*, the spindles 13*a*, 13*b* being attached perpendicular to respective arm 26*a*, 26*b*, and the spindles 13*a*, 13*b* being adapted to rotatably support a roll during dispensing. Each spindle 13*a*, 13*b* is provided with a rotatable sleeve 32. In FIG. 1A, the rotatable sleeves 32 are intended to interact with rolls disposed on the spindles 13*a*, 13*b*, allowing the rolls to rotate during dispensing of the web material from the roll.

The first spindle 13*a*, being attached to the first arm 26*a*, has a first end 17 directed towards the central side wall 222, and a second end 33 attached to the first arm 26*a*. The second spindle 13*b*, being attached to the second arm 26*b*, has a first end 17 directed towards the second side wall 223 and a second end 33 attached to the second arm 26*b*.

Figure 1B:
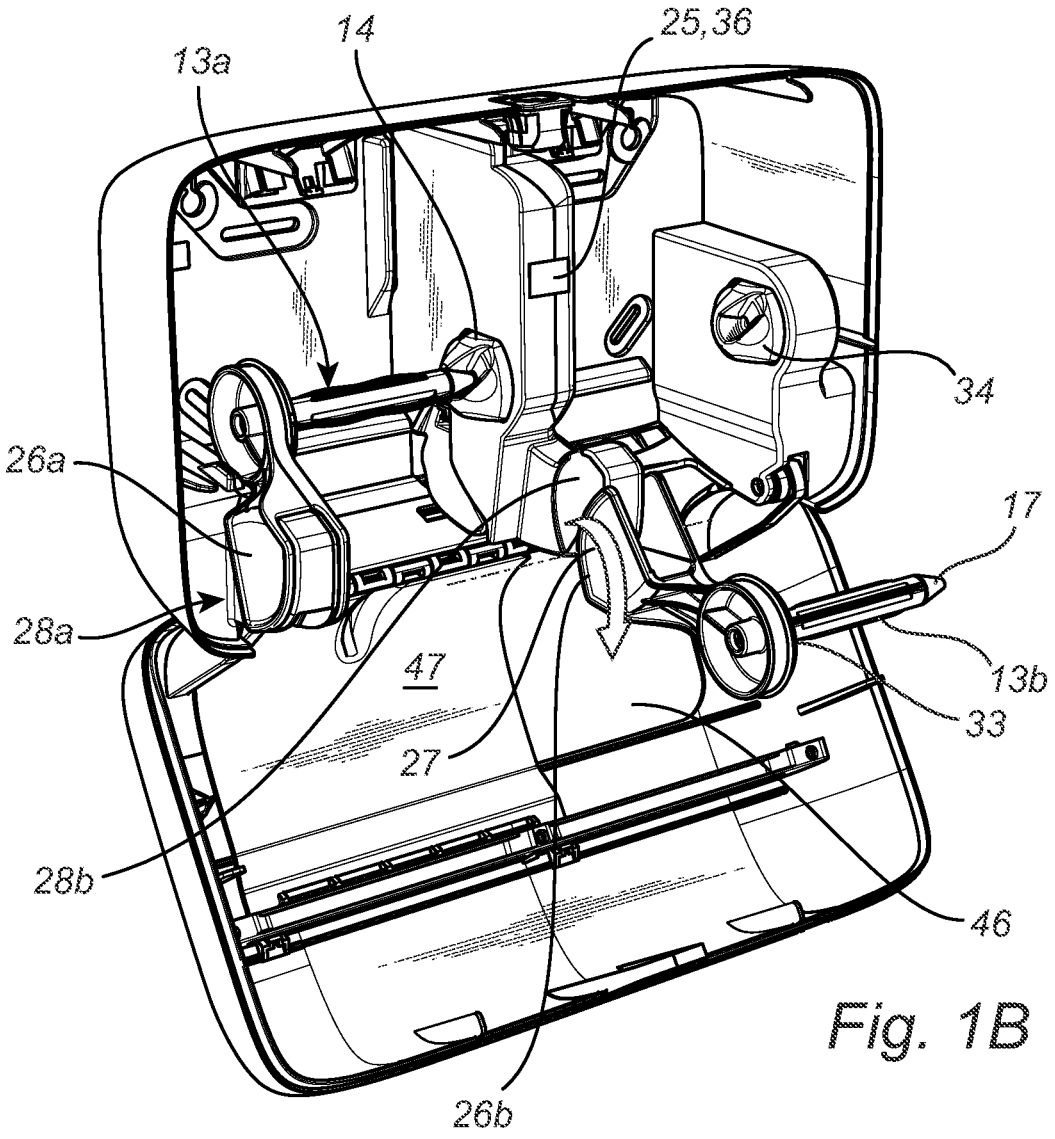
FIG. 1B is a perspective view of the dispenser disclosed herein, with a first spindle in dispensing position and a second spindle in loading position.

The spindles 13*a*, 13*b* are movable between a dispensing position and a loading position by means of the arms 26*a*, 26*b*. Each respective arm 26*a*, 26*b* has a spindle dispensing position in which the spindle 13*a*, 13*b* is arranged within the housing 12 of the dispenser 11, shown in FIG. 1A, and a spindle loading position in which the spindle 13*a*, 13*b* is arranged outside the housing 12 of the dispenser 11 in order to allow loading of a roll onto the spindle 13*a*, 13*b*, shown in FIG. 1B (second spindle 13*b*). The arms 26*a*, 26*b* are pivotable to place each respective spindle 13*a*, 13*b* in the two positions respectively, and the arms 26*a*, 26*b* are pivotable independently from each other, as shown in FIG. 1B. Hence, the spindles 13*a*, 13*b* are movable between loading position and dispensing position independent from each other.

A front cover 23 is hinged at to the lower parts of the outer side walls 221, 223, i.e. at the lower part of the dispenser 11. The front cover 23 is movable between an opened state, shown in FIGS. 1A and 1B, and a closed state (not shown). An engagement member 24 in the shape of a locking hook is arranged at the top of the front cover 23 in a central position corresponding to the central side wall 222 when the front cover 23 is in closed state. The front cover 23 has a dispensing opening 46 and a slidable lid 47 covering one half of the dispensing opening 46 at the time. The slidable lid 47 is slidable between two positions so that one roll at the time, arranged on the spindles 13*a*, 13*b*, are available for dispensing when the front cover 23 is in closed state.

If the front cover 23 is closed with the second arm 26*b* in loading position, as shown in FIG. 1B, the front cover will abut the arm 26*b* and push it upwards and inwards such that it folds over the support member 28*b* from a first position into a second position; placing the spindle 13*b* in dispensing position within the interior of the housing 12.

Figure 2A:
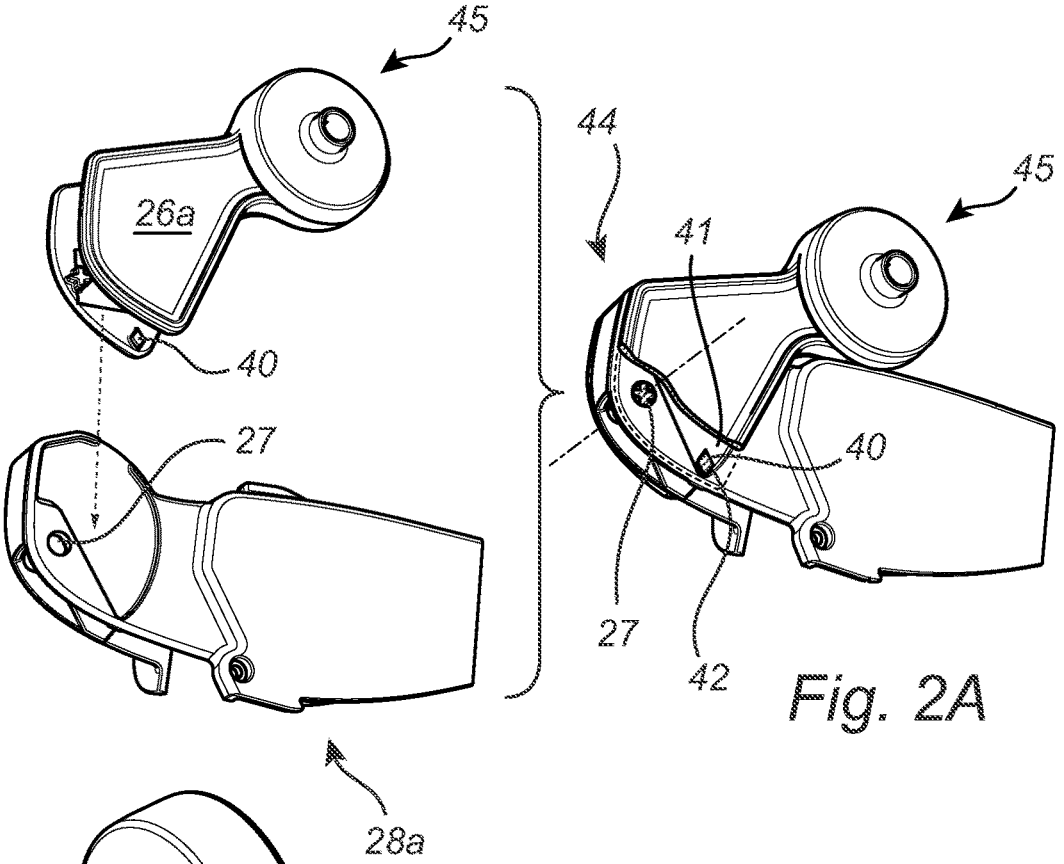
FIGS. 2A-E is a perspective view of the first arm in first, second and third position respectively.

FIGS. 2A-C and 2E shows the first arm 26*a* attached to a first support member 28*a* at a pivot point. The pivot point 27 is arranged at a first end 44 of the first arm 26*a*. In FIG. 2A the arm is folded at the pivot point 27 such that it partly encompasses the first support member 28*a*, i.e. the first arm 26*a* is in its first position and the first spindle 13*a* is in dispensing position. The first arm 26*a* comprises two legs 43 with a respective inner bearing surface 39. The two legs 43 are attached at the pivot point 27 to outer side surfaces 38 of the support member 28*a*, such that the bearing surfaces 39 of the first arm 26*a* bear against the outer side surfaces 38 of the support member 28. The first spindle 13*a* is attached at a second end 45 of the first arm 26*a* opposite the first end 44 comprising the legs 43 and pivot point 27. When the arm 26*a* is in its first position the spindle 13*a* in its dispensing position is arranged closer to the back wall 37 of the dispenser 11 than the hinge point 27 of the first arm 26*a*. In other words, the first arm 26*a* has been folded backwards over the first support member 28*a* and into the housing 12.

Figure 2B:
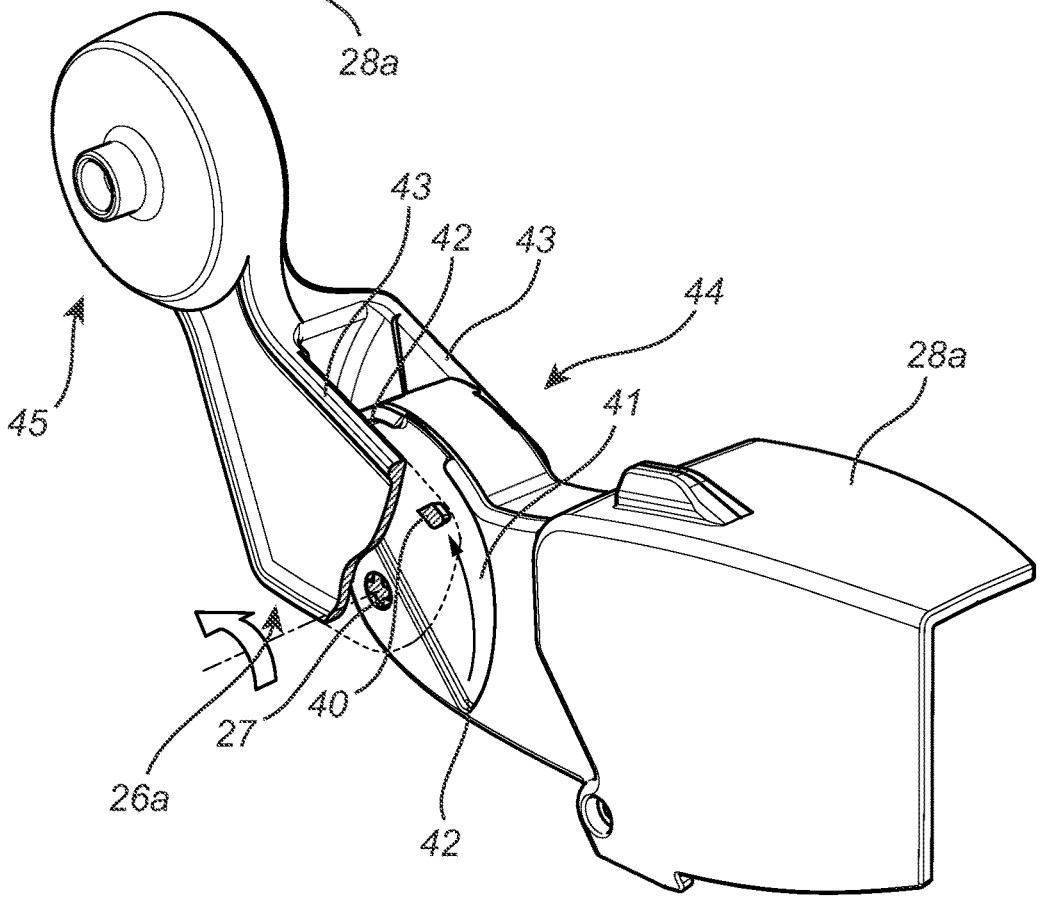

The two outer side surfaces 38 of the support member 28*a* each comprises a recess 41 and the bearing surfaces 39 of the first arm 26*a* each comprises a knob 40. The recess 41 is an area extending in a semi-circular manner from the top front to the lower back of the outer side surface. The bearing surfaces 39 bear against the outer side surfaces 38 as the arm 26*a* is moved between first and second position, and the knobs 40 slide in the complementary recesses 41 in order to guide the movement. In FIG. 2B the arm is in motion between its first and second position. Each recess 41 has an extension with closed end positions 42, and the knobs 40 slide in the recesses 41 between the closed end positions 42. The knobs 40 arranged in the closed end positions 42 of the recesses 41 corresponds to the first and second position of the first arm 26*a*, thereby positioning the first spindle 13*a* in dispensing and loading position respectively.

Figure 2C:
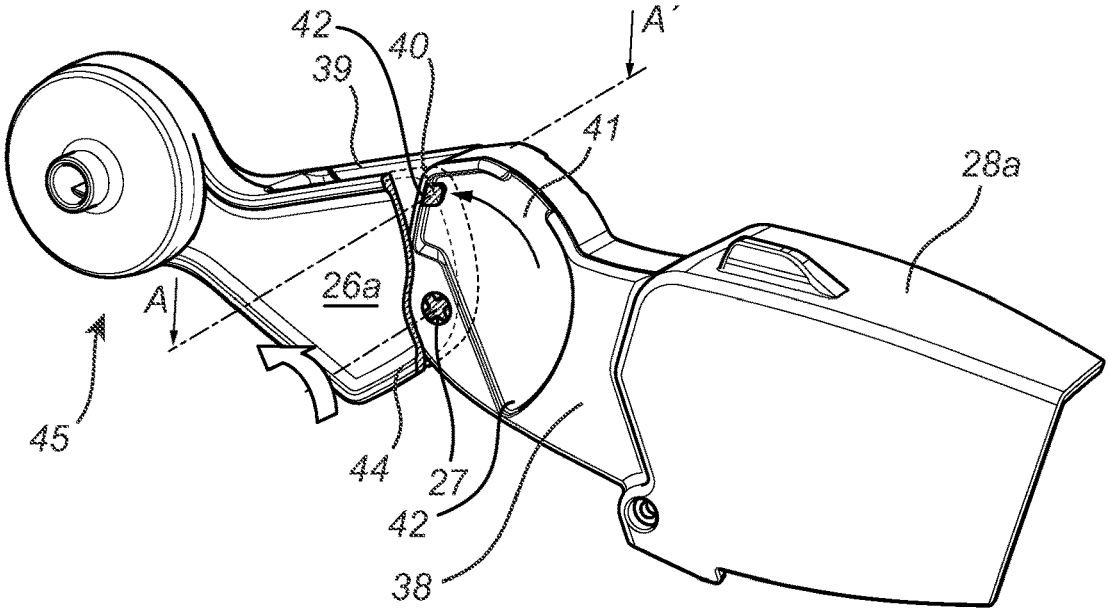

In FIG. 2C the first arm 26*a* is in its second position, folded outwards from the dispenser 11 interior, and the first spindle 13*a* is arranged in loading position.

Figure 2D:
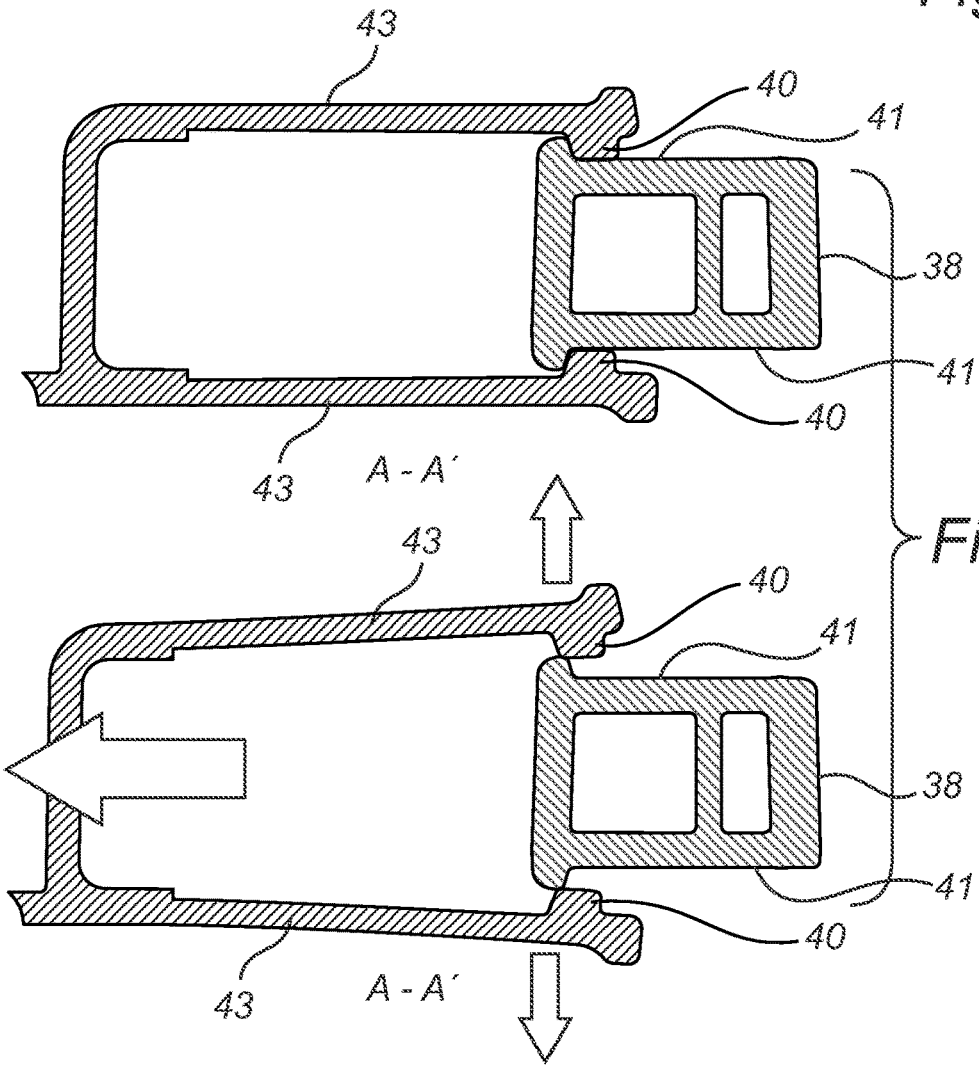
Figure 2E:
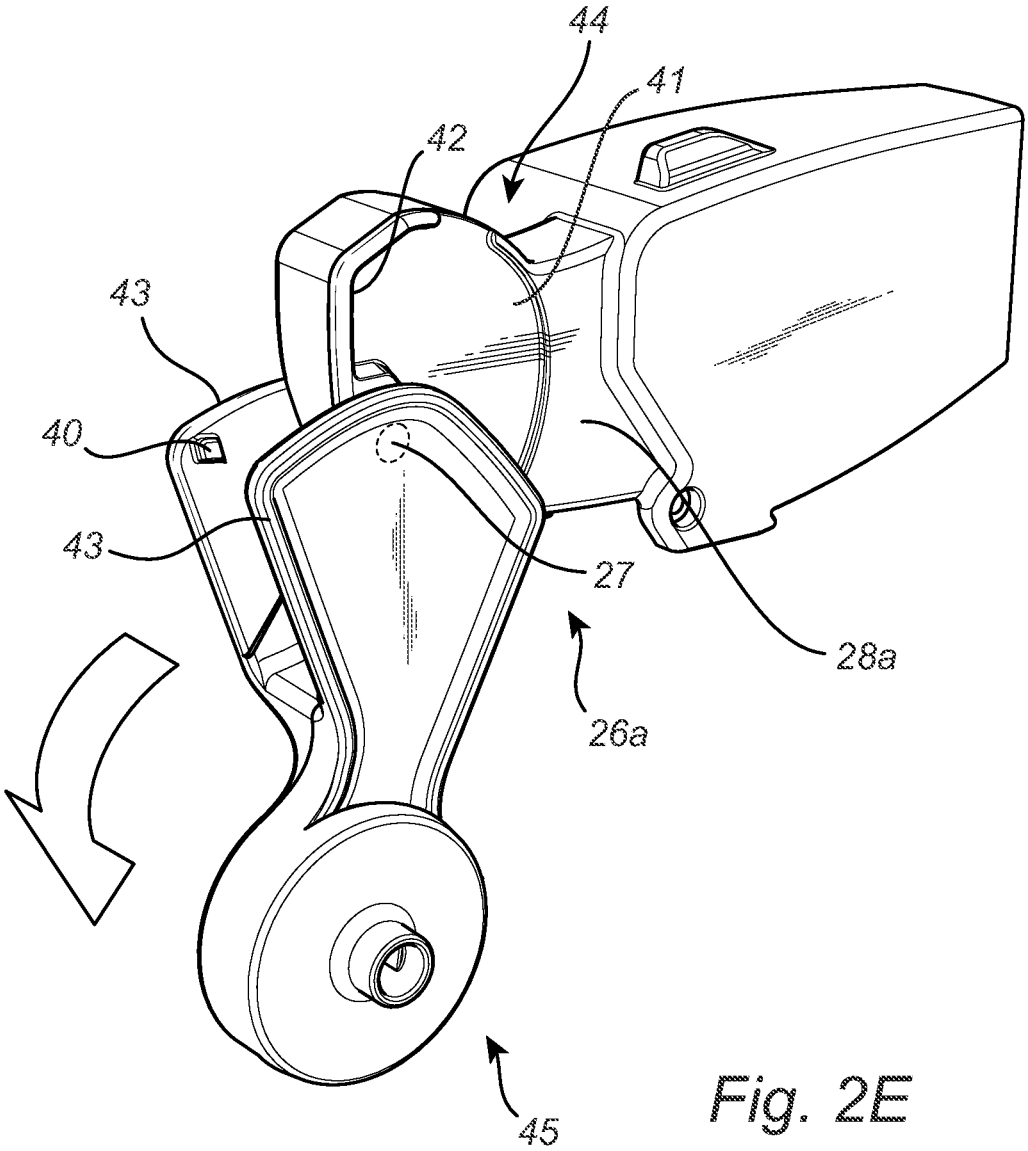

In FIG. 2E the first arm 26*a* is positioned in a third position hanging downwards. The third position is reached by an overload mechanism allowing the knobs 40 to snap out of the recesses 41 if a force above a predetermined release force is placed on the first spindle 13*a*. The snap out is shown in FIG. 2D, illustrating the legs 43 flexing outwards to allow the knobs 40 to pass the edge of the recesses 41. In FIG. 2E the knobs 40 has completely snapped out of the recesses 41 such that the first arm 26*a* has left its second position and rotated further about the hinge point 27 into its third position.

The second arm 26*b* and second support member 28*a*, not shown in FIGS. 2A-E, comprises the same elements as the first arm 26*a* and first support member 28*a*, and facilitate pivoting between first and second position in the same way. The overload mechanism may be present also between the second arm 26*b* and support member 28*b*.

A deflecting member 14 is arranged in the central side wall 222 of the housing 12. The deflecting member 14 is movable between a protruding position protruding towards the first spindle 13*a* in dispensing position, shown in FIG. 3A, and a retracted position retracted into the central side wall 222 of the housing 12 away from the spindle 13*a* in dispensing position, shown in FIG. 3B.

A receiving part 34 is arranged at the second side wall 223 and interacts with the first end 17 of the second spindle 13*b* in dispensing position. The receiving part 34 have the same frustoconical shape as the deflecting member 14.

Figure 3A:
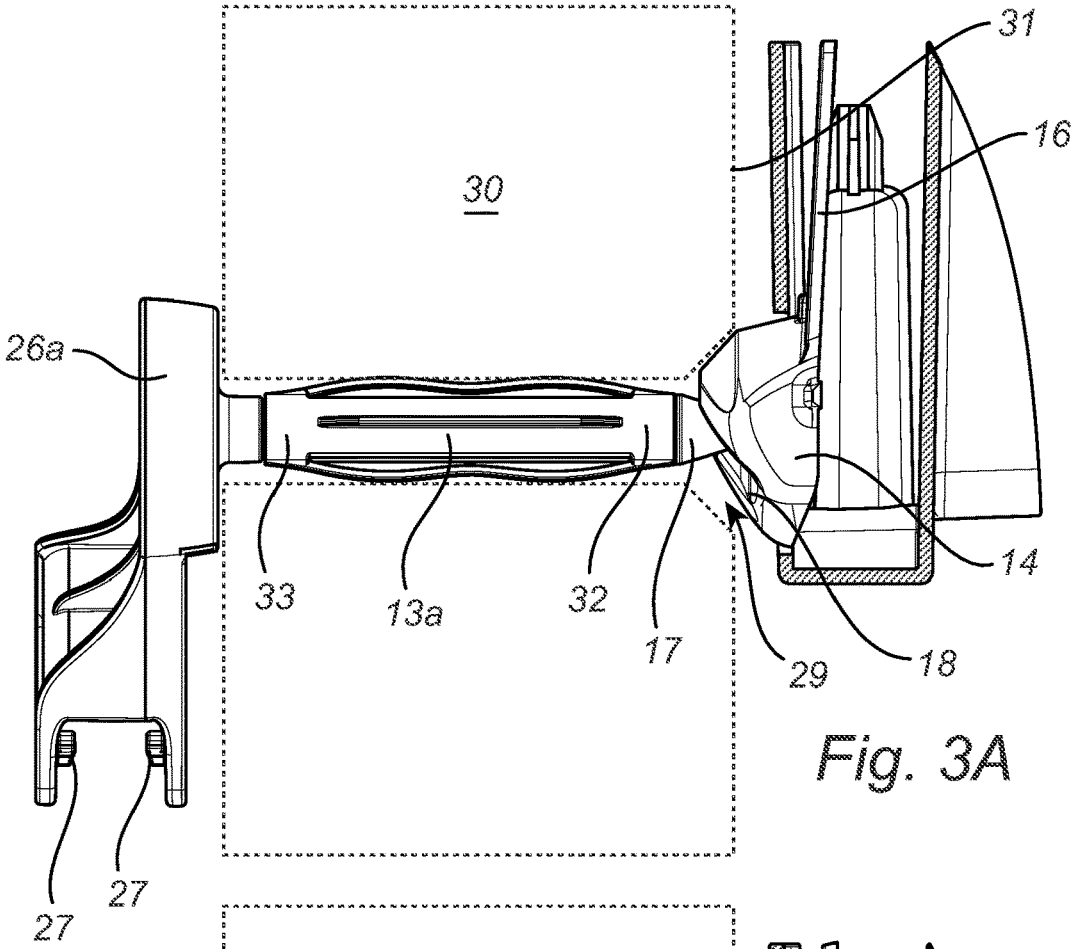
FIG. 3A is a perspective view of the deflecting member in protruding position.

The deflecting member 14 is connected to a resilient arm 16 connecting the deflecting member 14 to the central side wall 222 of the housing 12. In protruding position the deflecting member 14 is protruding from the side surface of the central side wall 222, protruding into the interior of the housing 12. In FIG. 3A a roll 30 having an indentation 29 at a first side 31 positioned at the first end 17 of the first spindle 13*a* is provided on the first spindle 13*a*. The indentation 29 is complementary to the frustoconical shape of the deflecting member 14 thereby allowing the deflecting member 14 to protrude into the indentation 29. No force is exerted on the deflecting member 14 and the resilient arm 16 is in relaxed state. The deflecting member 14 is in protruding position and the first spindle 13*a* is in the dispensing position. The first end 17 of the first spindle 13*a* is engaged in the deflecting member 14.

Figure 3B:
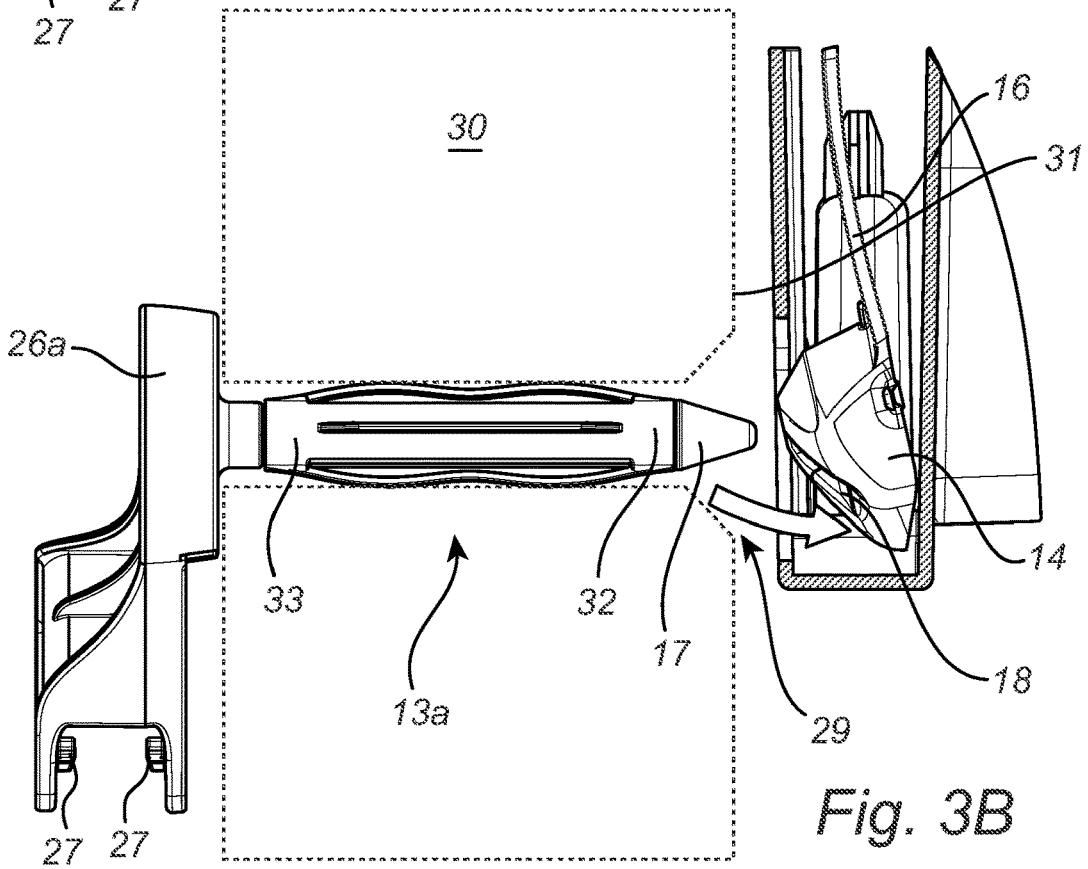
FIG. 3B is a perspective view of the deflecting member in retracted position.

If a force is applied to the deflecting member 14 the resilient arm 16 bends and the deflecting member 14 moves into its retracted position inside the central side wall 222, shown in FIG. 3B. This happens for example when the spindle 13*a* holding the roll 30 moves from loading to dispensing position and the side 31 of the roll 30 abuts the deflecting member 14. Once the spindle 13*a* is in dispensing position the force is removed due to the indentation 29 arranged adjacent the through hole in the side 31 of the roll 30, i.e. the tension on the resilient arm 16 is released and the deflecting member 14 flexes back into protruding position, shown in FIG. 3A.

If the roll 30 does not have a complementary shape indentation 29, or if the roll 30 is placed with the indentation 29 facing the second end 33 of the spindle 13*a*, the deflecting member will stay in retracted position.

The receiving part 34 having the same shape as the deflecting member 14 fits in an indentation 29 in a roll 30 being complementary to the shape of the deflecting member 14. It is movable between a protruding position and a retracted position.

Figure 4:
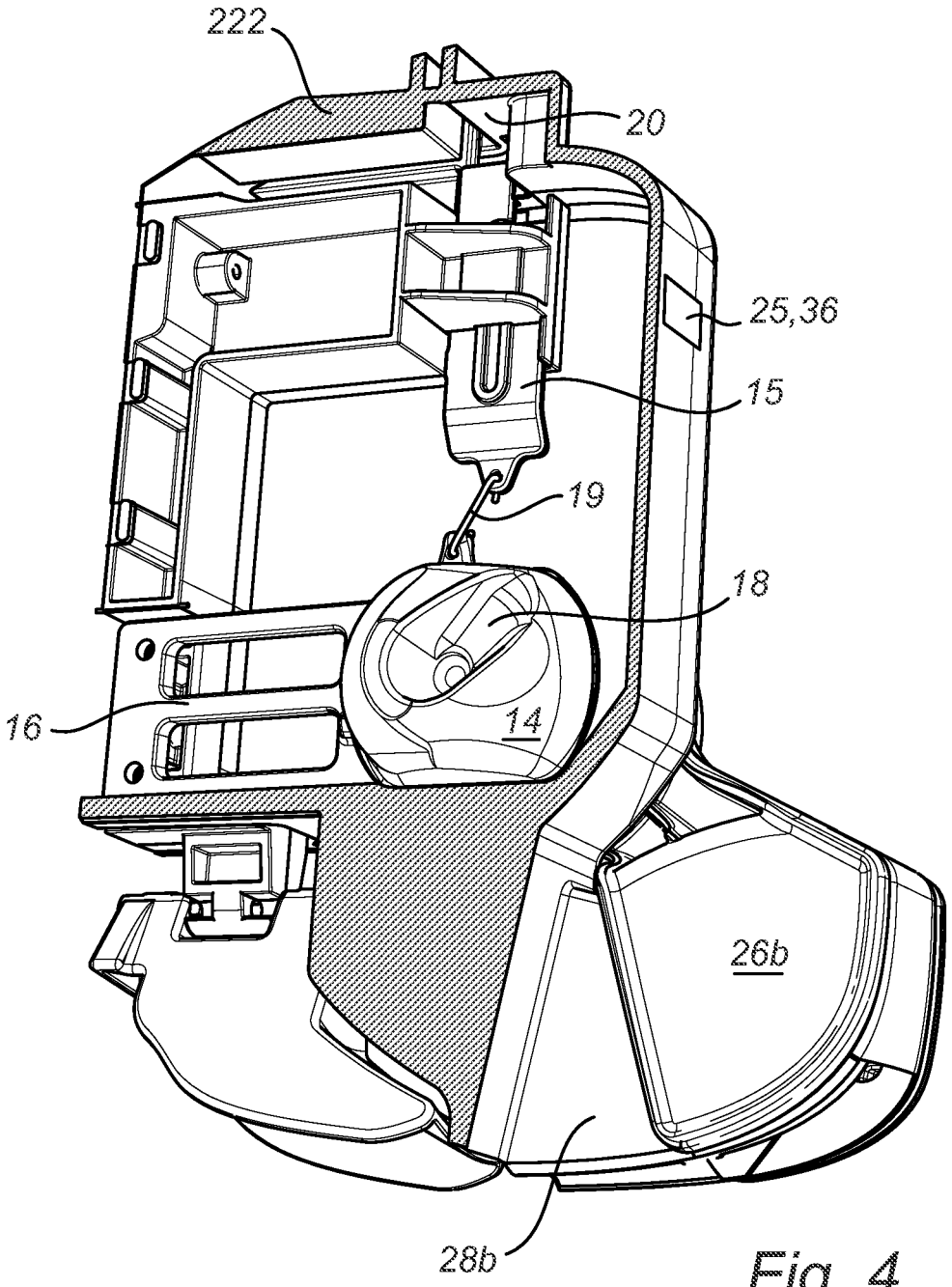
FIG. 4 is a cross-sectional view of the central side wall.

The central side wall 222 of FIGS. 1A-B is shown in FIGS. 4-5. Shown in FIG. 4; the deflecting member 14 is connected to a blocking member 15 by a rod 19 translating a horizontal movement of the deflecting member 14, between protruding position and retracted position in the central side wall 222, into vertical movement of the blocking member 15 moving it in and out of an engagement slot 20 in the central side wall 222 at the top wall 21.

Figure 5A:
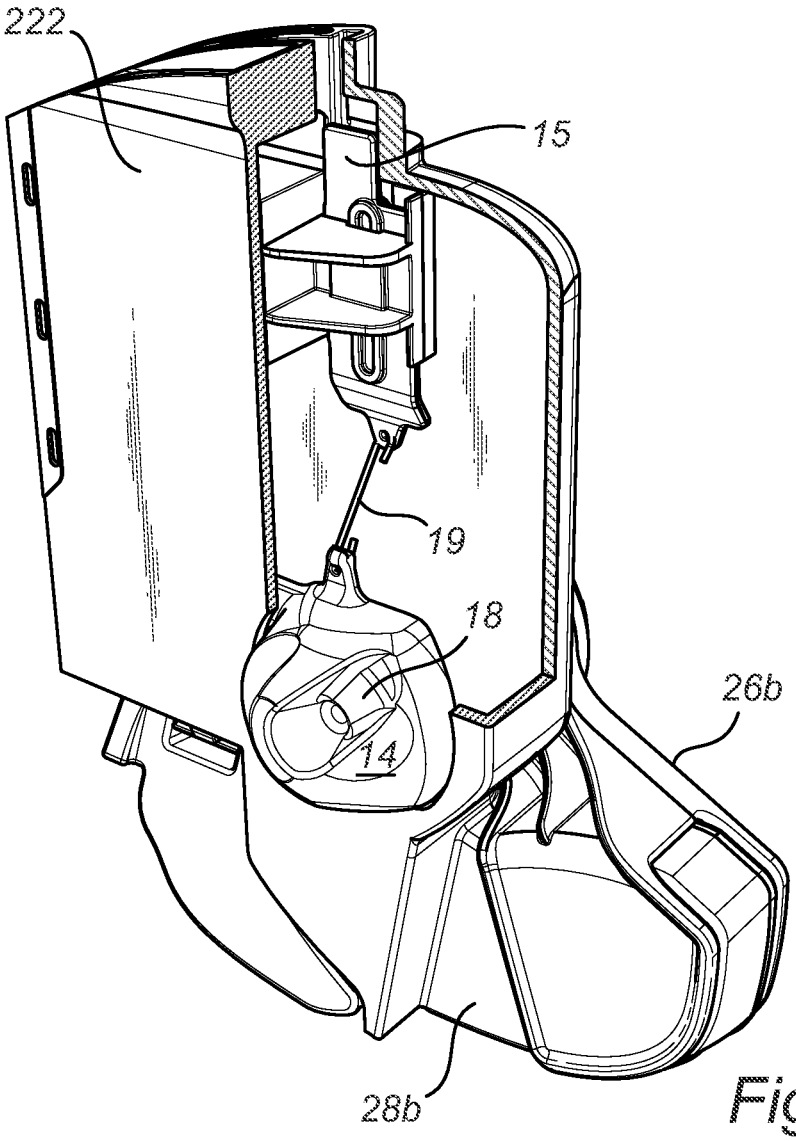
FIGS. 5A-B is a partly cross-sectional view of the central side wall with the deflecting member in protruding position and retracted position respectively.
Figure 5B:
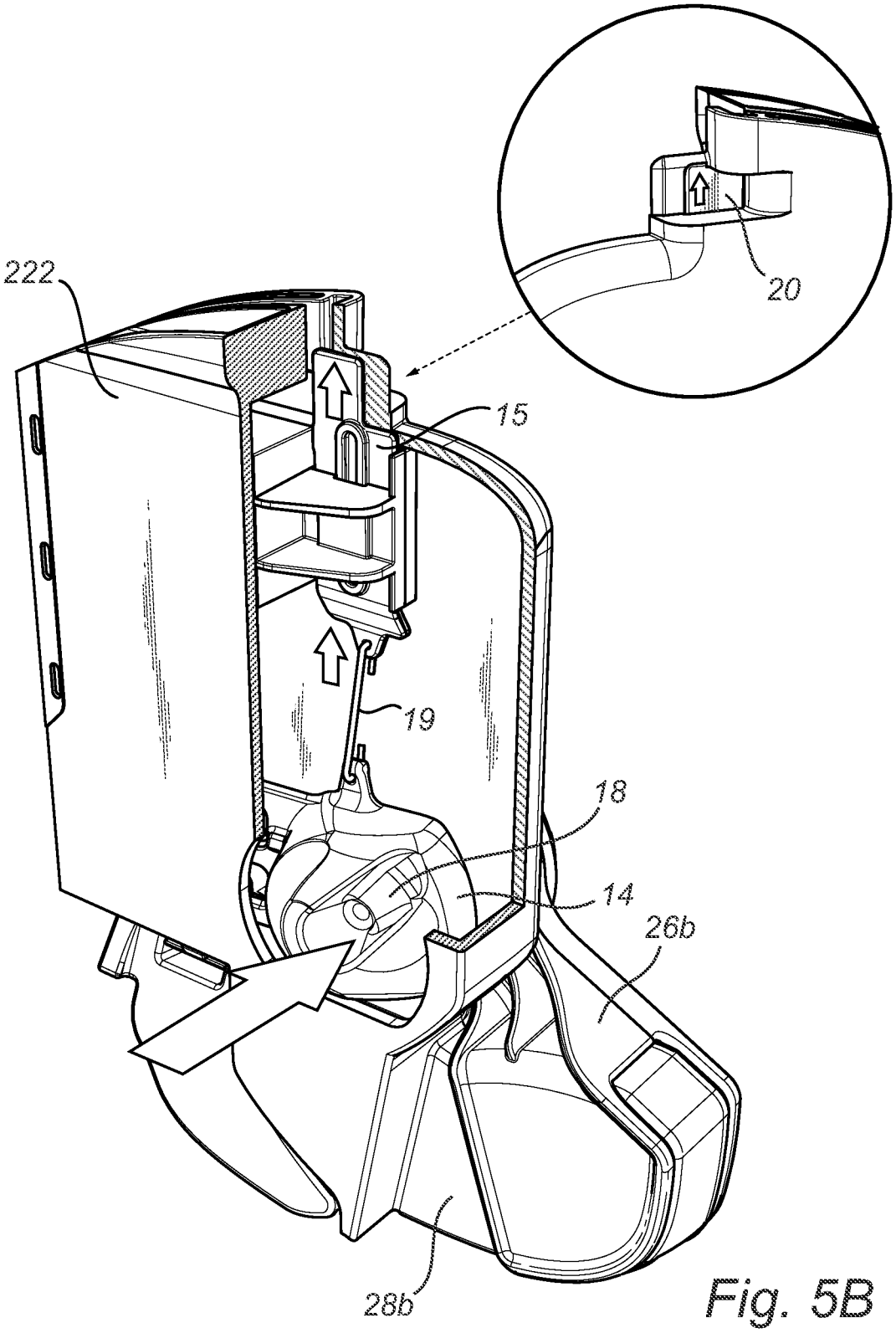

In FIG. 5A the deflecting member 14 is in protruding position, and the blocking member 15 is out of blocking position thereby not blocking the engagement slot 20 (seen in FIG. 4). The engagement slot 20 is thus available for the locking hook 24 of the front cover 23 to engage with, and the front cover 23 can thus be maintained and locked in closed position. In FIG. 5B the deflecting member 14 is pushed into retracted position, the resilient member 16 is tensed, the blocking member 15 is pushed upwards into the engagement slot 20 by the rod 19 and the engagement slot 20 is thereby blocked. The front cover 23 is unable to stay in closed position since the locking hook 24 cannot engage with the blocked engagement slot 20.

A color indication 36 is visible in an indication window 25, shown in FIGS. 1A-B, when the blocking member 15 is blocking the engagement slot 20. The indication 36 moves in and out of the indication window 25 with the movement of the blocking member 15 in and out of blocking position in the engagement slot 20. The indication 36 indicates to the service personnel if it is possible to lock the front cover 23 in closed state or not, thereby indicating if the roll 30 is correctly loaded or not.

Figure 6A:
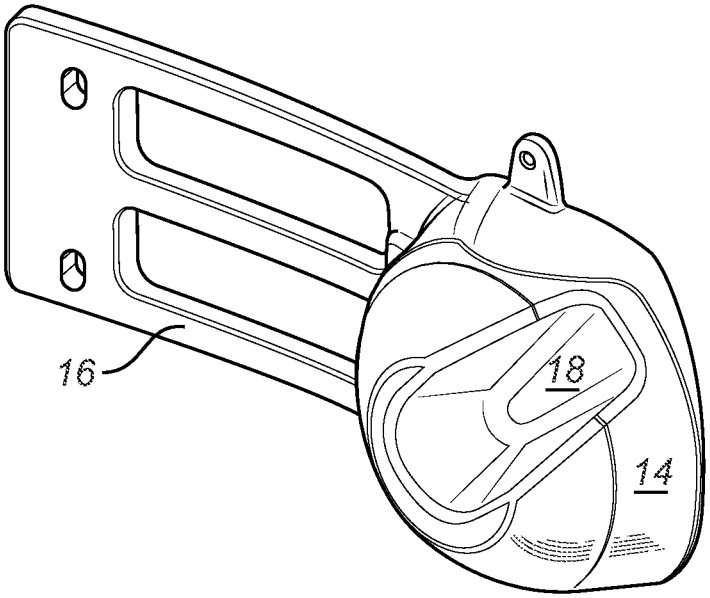
FIGS. 6A-B is a perspective view of the deflecting member and resilient member.
Figure 6B:
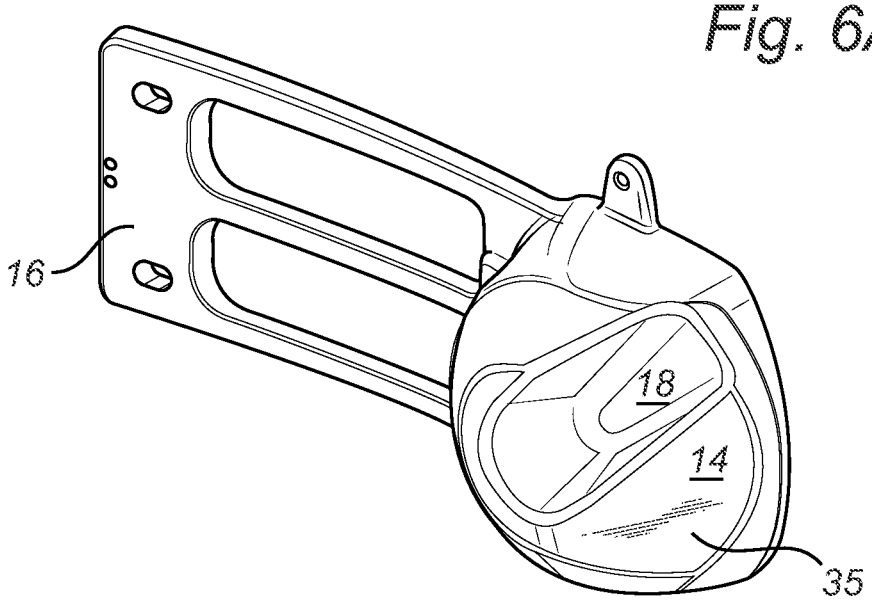

FIG. 6A shows a deflecting member 14 of truncated frustoconical shape comprising a guiding groove 18. The guiding groove 18 is adapted to receive the first end 17 of the first spindle 13*a* and guide it into an engaged position in the deflecting member 14 when the first spindle 13*a* is in dispensing position. In FIG. 6B the frustoconical shape is chamfered at one side to facilitate the edge of the first side 31 of the roll arranged on the spindle 13*a* to pass the deflecting member 14 when moved to dispensing position. The chamfered surface 35 is facing outwards from the interior of the housing 12, thereby facing the first end 17 of the first spindle 13*a* as it moves from loading position to dispensing position.

The invention claimed is:

1. Dispenser for dispensing web material from a roll, the dispenser comprising:

a housing comprising an engagement slot, a front cover; wherein said front cover has a closed and opened state, said front cover comprises an engagement member arranged to interact with said engagement slot when the front cover in closed state a spindle intended to rotatably support a roll of web material during dispensing, said spindle being movable between a loading position and a dispensing position, a deflecting member being movable between a protruding position protruding towards said spindle in dispensing position and a retracted position retracted into the housing away from the spindle in dispensing position; and wherein the deflecting member is connected to a blocking member moving in response to the movement of the deflecting member;

wherein said movement of the deflecting member translates into movement of the blocking member in and out of said engagement slot in the dispenser housing, and wherein said blocking member blocks the engagement slot when the deflecting member is in its retracted position.

2. Dispenser according to claim 1, wherein the deflecting member interacts with a resilient member arranged to allow the deflecting member to flex back into protruding position from retracted position.

3. Dispenser according to claim 1, wherein the deflecting member is arranged in the housing in order to receive a first end of the spindle when the spindle is in dispensing position.

4. Dispenser according to claim 3, wherein the deflecting member in protruding position engages said first end of said spindle.

5. Dispenser according to claim 3, wherein said deflecting member comprises a guiding groove adapted to receive said first end of the spindle and guide it into an engaged position when the spindle is in dispensing position.

6. Dispenser according to claim 1, wherein the housing comprises a top wall, side walls.

7. Dispenser according to the claim 6, wherein the engagement slot is arranged in the top wall of the dispenser housing.

8. Dispenser according to claim 1, wherein said blocking member is movable in a direction perpendicular to the movement of the deflecting member.

9. Dispenser according to claim 1, wherein the deflecting member is connected to the blocking member by a rod translating a horizontal movement of the deflecting member into vertical movement of the blocking member.

10. Dispenser according to claim 1, wherein said dispenser further comprises an indication window and an indication being visible in the indication window when the blocking member is in the engagement slot.

11. Dispenser according to claim 1, wherein said spindle is attached perpendicular to an arm, said arm being hinged at a hinge point to a support member, said arm being allowed to pivot about said hinge point, and said arm has a spindle dispensing position in which the spindle is arranged within the housing of the dispenser, said arm is pivotable between a first position in which said spindle is arranged in a dispensing position within the housing of the dispenser, and a second position in which said spindle is arranged in a loading position outside the housing of the dispenser in order to allow loading of a roll onto said spindle.

12. Dispenser according to claim 1, wherein said deflecting member has a shape adapted to fit in an indentation in a side of a roll arranged on the spindle.

13. Dispenser according to claim 12, wherein said deflecting member being adapted to be pushed into said retracted position in said dispenser housing when coming into contact with said side of a roll comprising an indentation complementary to the shape of the deflecting member as said spindle is moved into dispensing position, and said deflecting member being adapted to flex back into protruding position when the spindle reaches dispensing position.

14. Dispenser according to claim 1, wherein said deflecting member is at least partly frustoconical.

15. Dispenser according to claim 1, wherein the dispenser is a dual dispenser comprising two spindles intended to hold a roll respectively, and wherein the two spindles are movable between loading position and dispensing position independently from each other.

16. Dispenser according to claim 15, wherein the housing of the dual dispenser comprises a central side wall arranged between the two spindles, the deflecting member being arranged in the central side wall protruding from the central side wall towards a first of said spindles in dispensing position in its protruding position and the deflecting member retracted into the central side wall away from said first spindle in dispensing position in its retracted position.

17. Dispenser for dispensing web material from a roll, the dispenser comprising:

a housing and a front cover having an opened and a closed state, a spindle that is configured to rotatably support a roll of web material in a given orientation during dispensing, said spindle being movable between a loading position and a dispensing position, a deflecting member resiliently movable between a retracted position in which the deflecting member is retracted in the housing and a protruding position in which the deflecting member is protruding towards the interior of the dispenser, wherein the front cover in its closed state is blocked from interaction with the housing when the deflecting member is in retracted position.

18. Dispenser for dispensing web material from a roll, the dispenser comprising:

a housing comprising an engagement slot and a front cover having a closed state and an opened state, said front cover comprising an engagement member arranged to interact with the engagement slot in closed position, a spindle rotatably supporting a roll of web material, said spindle being movable between a loading position and a dispensing position, a deflecting member resiliently movable between a protruding position in which the deflecting member is protruding towards said spindle dispensing position and a retracted position in which the deflecting member is retracted into the housing away from the spindle dispensing position, and wherein said deflecting member being adapted to be moved into a retracted position by a first side of said roll when the spindle is moved from loading position to dispensing position, wherein the movement of the deflecting member translates into moving a blocking member into said engagement slot in order to hinder interaction between said engagement member and said engagement slot.

19. Dispenser according to claim 18, wherein said first side of said roll facing the deflecting member is provided with an indentation complementary to the shape of the deflecting member such that said blocking member moves out of the engagement slot, and said deflecting member is allowed to move back into protruding position.

20. Dispenser according to claim 18, wherein the roll is a coreless roll.

21. Method of loading a dispenser for dispensing web material from a roll, the dispenser comprising a housing and a front cover, a spindle adapted to rotatably support a roll of web material during dispensing, said spindle having a dispensing position and a loading position, a deflecting member having a shape and being movable between a protruding position protruding towards said spindle dispensing position and a retracted position retracted into the housing away from said spindle dispensing position, wherein the method comprises:

placing a roll comprising an indentation complementary to the shape of the deflecting member on said spindle in loading position, moving said spindle from said loading position towards said dispensing position, allowing a first side of said roll, comprising the indentation, to push against said deflecting member in order to move it from said protruding position to said retracted position, wherein the movement of the deflecting member translates into movement of a blocking member into a blocking position, allowing the deflecting member to flex back into protruding position once the spindle is in dispensing position in order to move said blocking member out of said blocking position, moving the front cover to a closed state.

22. Method of loading a dispenser according to claim 21, wherein the blocking position of the blocking member blocks an engagement slot arranged in the housing of the dispenser.

23. Method of loading a dispenser according to claim 21, wherein the method further includes:

locking the front cover in closed state by allowing an engagement member arranged on the front cover to interact with said engagement slot.

* * * * *